United States Patent [19]

Schimko

[11] Patent Number: 4,662,192

[45] Date of Patent: May 5, 1987

[54] FLAT KNITTING MACHINE

[75] Inventor: Reinhold Schimko, Aalen-Wasseralfingen, Fed. Rep. of Germany

[73] Assignee: Universal Maschinenfabrik Dr. Robert Schieber GmbH & Co. KG, Westhausen, Fed. Rep. of Germany

[21] Appl. No.: 881,747

[22] Filed: Jul. 3, 1986

[30] Foreign Application Priority Data

Jul. 4, 1985 [DE] Fed. Rep. of Germany ..... 3523989

[51] Int. Cl.[4] ..... D04B 7/00

[52] U.S. Cl. ..... 66/75.1

[58] Field of Search ..... 66/75.1, 75.2

[56] References Cited

U.S. PATENT DOCUMENTS

| | | | |
|---|---|---|---|
| 3,715,897 | 2/1973 | Hadam | 66/75.2 |
| 3,892,108 | 7/1975 | Hadam | 66/75.2 |
| 3,955,381 | 5/1976 | Panchaud | 66/75.1 |
| 4,287,727 | 9/1981 | Otoshi | 66/75.2 |
| 4,490,994 | 1/1985 | Essig | 66/75.2 |

FOREIGN PATENT DOCUMENTS

| | | | |
|---|---|---|---|
| 2656824 | 6/1978 | Fed. Rep. of Germany | 66/75.1 |

*Primary Examiner*—Ronald Feldbaum
*Attorney, Agent, or Firm*—Sughrue, Mion, Zinn, Macpeak & Seas

[57] ABSTRACT

A flat knitting machine comprises flexible shank needles arranged in the needle channels of the needle bed, and, arranged behind these, jacquard jacks as well as a cam system which is movable over the needle bed and which comprises interengageable needle, jacquard and selection cam units which have fixed and shiftable cam elements. In order to create the possibility of selection for the flexible shank needles with sinkable needle butts, and in which the needle channel cutting is without interruption, i.e. can be produced with constant depth by one cutting pass, the flexible shank needles have an anterior first needle butt always projecting from the needle bed and a posterior second needle butt which sinks into the needle bed under the resilience of its own flexible shank. Behind each flexible shank needle there is provided a displaceable arresting jack having an arresting jack butt as well as a coupling portion at its forward end for coupling to the flexible shank of the flexible shank needle and for simultaneously lifting the second needle butt from the needle bed. Behind the arresting jack there is displaceably mounted a jacquard jack which has a first, operating butt and a second, selection butt. In the needle cam unit, at least in the region of the second needle butt, and symmetrically arranged with respect to the central longitudinal axis of the cam system, there are provided two needle sinkers displaceable in the plane of the cam system and two cam units shiftable into and out of the plane of the cam system for extending the needles in the formation of stitches.

9 Claims, 15 Drawing Figures

FLAT KNITTING MACHINE

FIELD OF THE INVENTION

This invention relates to a flat knitting machine comprising flexible shank needles arranged in the needle channels of the needle bed, each said needle having an anterior first needle butt always projecting from the needle bed and a posterior second needle butt which sinks into the needle bed under the resilience of its own flexible shank, jacquard jacks arranged rearwardly of the flexible shank needles for selective lifting of said second needle butts, and cam means movable over the needle bed and comprising interengageable needle, jacquard and selection cam units incorporating fixed and shiftable cam elements. One such flat knitting machine is known for example from the publication "Wirkerei- und Strickerei-Technik", Coburg, February 1960, No. 2, page 835.

Generally, fabric technology in modern flat knitting is based on the formation of stitches and tuck loops and upon the absence of knitting during the course of a row of knitting. From the combination possibilities of these three formation processes, in combination with the needle bed filling, stitch transfer and changes of colour, all patterns can be created. In order to be able to achieve an optimisation of these patterns, additional possibilities have been created which, on the one hand, by different withdrawal depths of the needles within a row of knitting, permit the production of prominent relief patterns for example, and which, on the other hand, by the formation of the needles with needle butts which are lowerable into the needle bed offer the possibility of not having to withdraw needles which are loaded with stitches but which are not operating in a given row of knitting, and consequently to take care of such stitches. In order to carry out all these techniques, the most varied combinations of needles and jacks are known.

With the presently known techniques which use needles having needle butts which are lowerable in the needle beds it is always necessary that the bottom of the needle channel in the needle bed is slotted on two different levels. The needle channels are slotted deeper in the needle bed space required for the lowering of the needle butts than in the needle bed space needed for the formation of stitches in the forward region immediately behind the abutment cams. The manufacture of such needle beds is considerably more complex and expensive than the cutting of needle channels in conventional flat knitting machines without lowerable needle butts, in which the needle channel cutting can take place in one pass and without stepping.

SUMMARY OF THE INVENTION

It is an object of the present invention to provide a flat knitting machine of the type first referred to above which permits all selection possibilities for the sinkable needle butts, and in which the cutting of the needle channels in the needle bed can be carried out without stepping, in other words in one cutting pass with constant cutting depth.

This is achieved in accordance with the present invention, in a flat knitting machine of the type first referred to above, in that (*a*) behind each flexible shank needle there is provided a displaceable arresting jack having both an arresting jack butt and also a coupling portion at its forward end for coupling to the flexible shank of the flexible shank needle and for simultaneously lifting said second needle butt from the needle bed, (*b*) behind the arresting jack there is displaceably mounted a jacquard jack which has a first, operating butt and a second, selection butt, and (*c*) in the needle cam unit, at least in the region of said second needle butt, and symmetrically arranged with respect to the central longitudinal axis of the cam means, there are provided two needle sinkers displaceable in the plane of the cam means and two cam units shiftable into and out of the plane of the cam means for extending the needles for the formation of stitches.

Preferably, in the needle cam unit, in the region of said first needle butt, and symmetrically arranged with respect to the central longitudinal axis of the cam means, there are provided two needle sinkers displaceable in the plane of the cam means and two cam units shiftable into and out of the plane of the cam means for extending the needles for the formation of stitches, and also a shiftable needle sinker cam unit provided in the region of one of said needle sinkers. Four selectively shiftable selection keys may be provided in the selection cam unit and symmetrically with respect to the central longitudinal axis of the cam means.

With the flat knitting machine of the present invention, in combination with a flexible shank needle, all arresting and selection jacks with the associated cam means create the possibility of a needle selection which covers the full spectrum of the fabric technology as described above, including transfer of stitches and knitting with different withdrawal depths within one row of knitting, with a very simple and cost-effective needle bed with a compact cam structure. The second needle butt occupies the position raised up from the needle bed always immediately against the arresting jack and consequently is supported strongly by the bottom of the needle channel.

In one simplified embodiment of the invention, in which no selective differential needle withdrawals can be achieved in one row of knitting, the displaceable needle sinkers in the needle cam unit in the region of the first needle butts are replaced by fixed cam units and said two shiftable cam units are omitted.

According to a further alternative within the scope of the invention, the shiftable needle sinker cam unit in the needle cam unit in the region of the first needle butt is omitted and the displaceable needle sinkers are arranged to be retractable, for example pivotable.

Preferably, at the underside of each said second needle butt, there is an arresting cam with two oppositely directed inclined cam surfaces, while the coupling portion of each arresting jack has a latching groove for receiving the arresting cam and is provided at its forward end with two further oppositely directed inclined cam surfaces. By this means one achieves a particularly compact and functionally reliable coupling and uncoupling of the flexible shank needle and arresting jack.

The jacquard jack is preferably arranged to be slidable in part on the arresting jack.

Furthermore, the active operating region of the arresting jack butt preferable extends over the width of a lengthwise recess in the upper surface of the needle bed.

The selection butts of successive jacquard jacks and the associated selection keys are preferably arranged staggered in the lengthwise direction of the needle channels.

BRIEF DESCRIPTION OF THE DRAWINGS

The invention will now be described in more detail with reference to a number of embodiments which are given by way of example and which are illustrated in the drawings. In the drawings.

DESCRIPTION OF THE PREFERRED EMBODIMENTS

In FIGS. 1 to 4 there are shown cross-sectional views through a needle bed 1, taken along the length of the needle channel, illustrating various different positions of a flexible shank needle 2, an arresting jack 3 and a jacquard jack 4 relative to one another, before the coupling of the flexible shank needle 2 to the arresting jack 3, as well as showing the coupled state of these two latter components.

Figure 1:
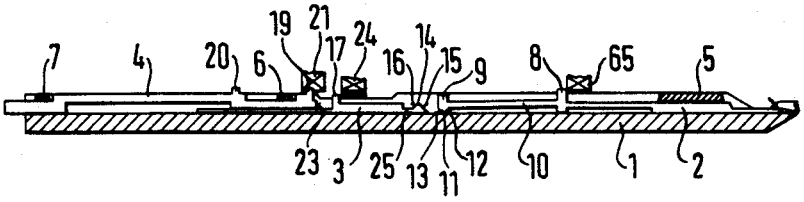
FIG. 1 is a cross-sectional view through a needle bed, taken along the length of a needle bed channel, with a flexible shank needle shown in its basic, inactive position and with an arresting jack and jacquard jack also inactive.

In FIG. 1 the flexible shank needle 2 is shown in the level-cams position where it is inactive (basic position); the arresting jack 3 and the jacquard jack 4 are also inactive.

The needle channels in the needle bed 1 are all formed with the same depth and with the same depth throughout their length. The flexible shank needles 2, the arresting jacks 3 and the jacquard jacks 4 are held in the needle bed by cover strips 5,6 and 7 respectively.

Each flexible shank needle 2 has a first needle butt and a second needle butt 9. The first, anterior needle butt 8 always projects from the needle bed 1. The second needle butt 9 is arranged at the rear end of a flexible shank 10 of the flexible shank needle 2 and is inactive in its basic position, i.e. it disappears into the needle bed 1 by virtue of the springiness of its own flexible shank 10.

At the underside of the second needle butt 9 there is provided an arresting cam 11 which, in its basic position, rests upon the bottom of the needle channel. The arresting cam 11 has two oppositely directed inclined cam surfaces 12 and 13 which are required for the coupling of the flexible shank needle 2 to the arresting jack 3.

At its anterior end the arresting jack 3 has a coupling portion 14 which is formed with two further oppositely directed inclined cam surfaces 15 and 16. Behind the coupling portion 14 there is a latching groove 25 to receive the arresting cam 11 of the flexible shank needle 2. Additionally, the arresting jack 3 has an arresting jack butt 17 whose active working zone extends over the width of a lengthwise recess 18 in the upper surface of the needle bed 1. The arresting jack butt 17 projects above the bottom of the lengthwise recess 18 but not however above the upper surface of the needle bed 1.

The jacquard jack 4, which is arranged in part to be slidable on the arresting jack 3, is provided with a first, operating butt 19 and a second, selection butt 20. The selection butts 20 of adjacent jacquard jacks 4 are staggered in their respective positions, i.e. are arranged there with different repeating spacings from the cover strip 7.

Figure 2:
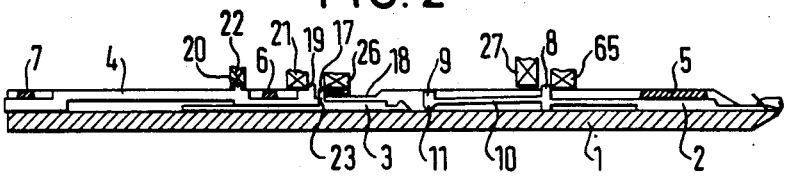
FIG. 2 is a cross-sectional view, as in FIG. 1, with the jacquard jack located in its basic position and having its selection butt brought into the selection zone.

When the carriage of the flat knitting machine, with its cams, is moved over the needle bed 1, then one cam unit 21 engages the operating butt 19 of the jacquard jack 4 and brings the jacquard jack 4 from the position shown in FIG. 1 to the position shown in FIG. 2, in which latter position the jacquard jack 4 occupies its basic position. In this position of the basic setting the jacquard jack 4 has its anterior end 23 resting directly against the arresting jack butt 17, and has its selection butt 20 brought into the selection zone in which an actuated or chosen selection key (lifting triangle) 22 (indicated in FIGS. 5 to 15 at 37, 38, 39 and 40) can strike the selection butt 20.

The position of the jacquard jack 4, as it is shown in FIG. 1, can be captured within the cam in the region of maximum withdrawal by all needle sinkers of the cam, but before the cam relinquishes this position and is brought back again to the position shown in FIG. 2, in connection with which reference is also made to FIGS. 5 to 15.

Figure 3:
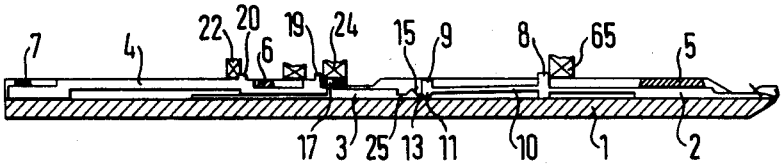
FIG. 3 is a cross-sectional view, as in FIG. 1, in which the arresting jack is shown immediately before its coupling with the flexible shank needle.
Figure 4:
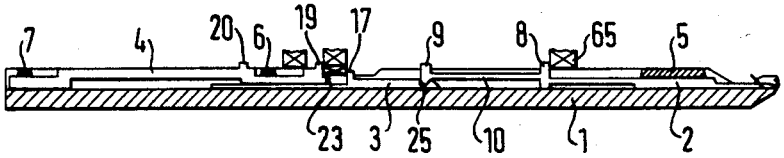
FIG. 4 is a cross-sectional view, as in FIG. 1, in which the arresting jack is coupled to the flexible shank needle.

If now a flexible shank needle 2 is to be selected, then the jacquard jack 4, which has been brought by the cam unit 21 (see also FIG. 5 ) into the position shown in FIG. 2, is extended by the chosen selection key 22 (37 to 40) so far until the arresting jack butt 17 of the arresting jack 3 can be engaged by a cam unit 24 (FIG. 3). The arresting jack 3 thus chosen now has its inclined cam surface 15 confronting the needle cam surface 13. The cam unit 24 moves the arresting jack 3 further forward, and a cam unit 65 is positioned in front of the first needle butt 8 which always projects from the needle bed 1 and prevents any sliding away of the flexible shank needle 2 upon the then following coupling movement between arresting jack 3 and flexible shank needle 2. In this coupling movement the inclined cam surface 15 of the arresting jack rides on the inclined cam surface 13 of the needle, lifts the springy needle shank 10 at the second needle butt 9 and enables the arresting cam 11 to drop into the latching groove 25 FIG. 4). The second needle butt 9 emerges from the needle bed 1 and comes into the zone of the cam units shown in FIGS. 5 to 15 which move the flexible shank needles 2 for operation.

The uncoupling of the flexible shank needle 2 and the arresting jack 3 follows in the inverse manner, with a withdrawal element 26 moving the arresting jack 3 downwards (and to the left) and a cam unit 27 holding the flexible shank needle 2 fast by its first needle butt 8, so that the uncoupling can take place (FIG. 2).

A preferred embodiment of cam system which is appropriate for the aforesaid movements is shown in FIGS. 5 to 13. This cam system comprises five shiftable cam units 28,29,30,31 and 32 as well as four needle sinkers 33,34 35 and 36 which are displaceable in the plane of the cams. Lifting triangles or selection keys 37,38,39 and 40 can be brought into action or taken out of action by means of magnets for the purpose of needle selection. The remaining cam units (shown by vertical hatching) are stationary and are not shiftable. The central longitudinal axis of the system of cam units is indicated at M.

In the embodiment of cam system shown in FIGS. 5 to 13 one can knit in one row of knitting either selected stitches or tuck loops or knit with the three-path technique with selectively chosen needles and with different size stitches and tuck loops. Furthermore, with this cam system, any transfer can be made, in both directions of traverse of the carriage, to the rear needle bed or to the forward needle bed or to both needle beds at the same time.

Figure 5:
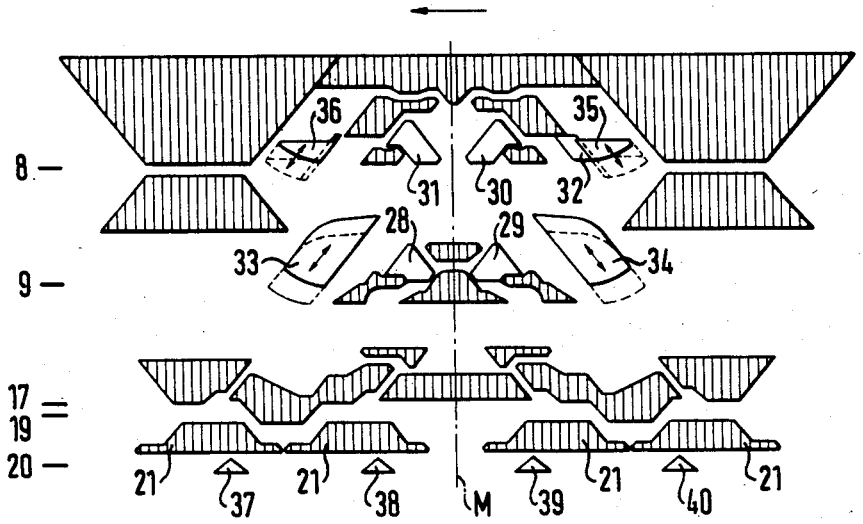
FIG. 5 is a schematic plan view of a preferred embodiment of cam system according to the invention.

FIG. 5 shows this preferred first embodiment of cam system with the most important reference numbers present.

Figure 6:
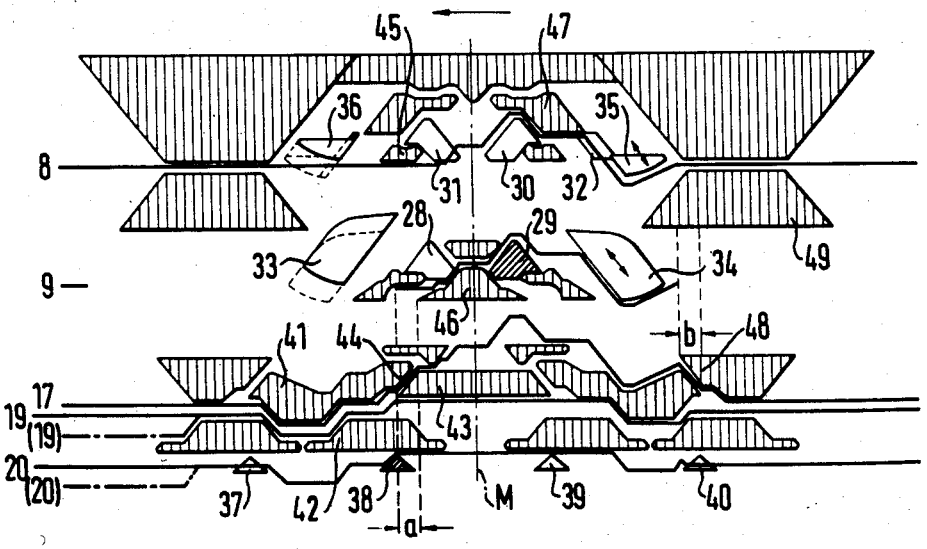
FIG. 6 is a plan view, as in FIG. 5, shifted for the formation of stitches of equal withdrawal length.

FIG. 6 shows the shifting of the cam system for a carriage movement from right to left and for a needle pass and jack pass for the production of equal size stitches. The selection key 38 and the cam unit 29 are shifted into action. The needles and jacks occupy their basic positions. The second needle butt 9 remains sunk in the needle bed 1, in other words outside the relevant cam zone. The needle sinker 34 is brought to the withdrawal position and the needle sinker 35 is set manually or by stepping motors to the same withdrawal depth or to the level-cams position. Here, as in the following Figures, the coupling zone within the cam system is indicated by a and the uncoupling zone within the cam system as indicated by b.

Each arresting jack butt 17 is brought again into the initial position by a stationary cam unit 41 which moves it positively downwards and by a following stationary lifting cam unit 42 which engages against the operating butt 19 of the jacquard jack 4. These movements are required successively on account of maximum withdrawal depth and are carried out automatically in the advancing sense for these reasons.

The selection key 38 comes into action and, by means of the selection butt of the jacquard jack 4, moves the arresting jack butt 17 into the zone of a cam unit 43 in whose lifting zone 44 the coupling between the arresting jack 3 and the flexible shank needle 2 takes place, in other words in the coupling zone a. A stationary cam unit 45 holds the flexible shank needle 2 by means of its first needle butt 8 in its position, so that the needle cannot deflect upwards upon coupling. The second needle butt 9 comes into action upon coupling, and is engaged by a fixed cam unit 46 as well as by the active cam unit 29, and the flexible shank needle 2 is extended to the stitch matrix level. A fixed cam unit 47 limits the lifting of the flexible shank needle 2 upwards and, together with the needle sinker 34, complemented by the action of the needle sinker 35, guarantees in known manner the withdrawal of the needle for laying in the thread and for the formation of the stitch.

The arresting jack 3 causes the movement of the flexible shank needle 2 forcibly as far as fixed cam units 48 and 49, into the uncoupling zone b for the uncoupling of them both. By this means the cam unit 49 limits the movement of the flexible shank needle 2 downwards by engagement against the first needle butt 8, and consequently upon the downward movement of the arresting jack 3, moved by the engagement of the cam unit 48 against the arresting jack butt 17, the uncoupling can take place. Finally, the jacquard jack 4 is displaced forcibly into the initial position by engagement against its operating butt 19.

Figure 7:
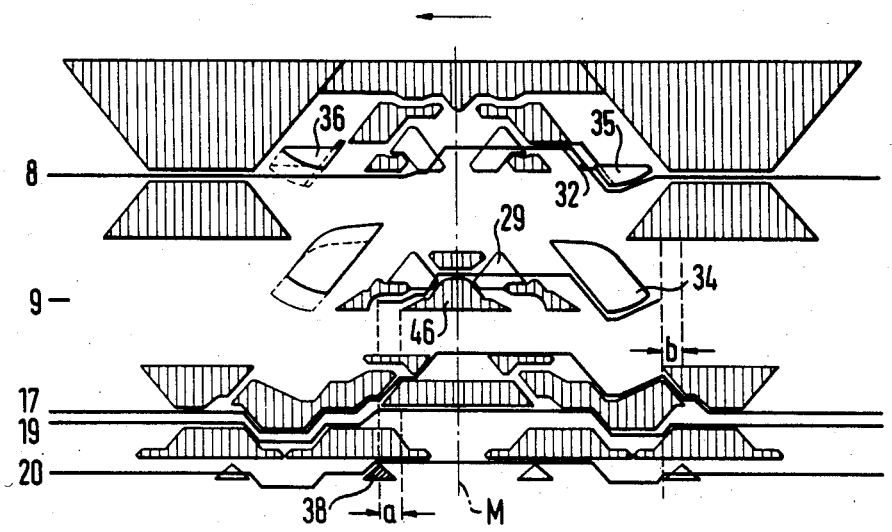
FIG. 7 is a plan view, as in FIG. 5, shifted for the formation of tuck loops of equal withdrawal length.

FIG. 7 shows the shifting of the cam system of FIG. 6 under the same conditions, but for equal size tuck loops. Here again the selection key 38 is active and the needle sinker 34 has been brought to the withdrawal position. The needle sinker 35 occupies the same setting or higher. The selection of the flexible shank needles which are to form the tuck loop is the same as has been described above with reference to FIG. 6 in connection with the formation of stitches. The cam unit 29 is not brought into action however, so that the selected flexible shank needles 2 are extended by the cam unit 46 to the tuck level and remain there until the subsequent withdrawal, with the further needle pass and jack pass being the same as described above in connection with FIG. 6.

Figure 8:
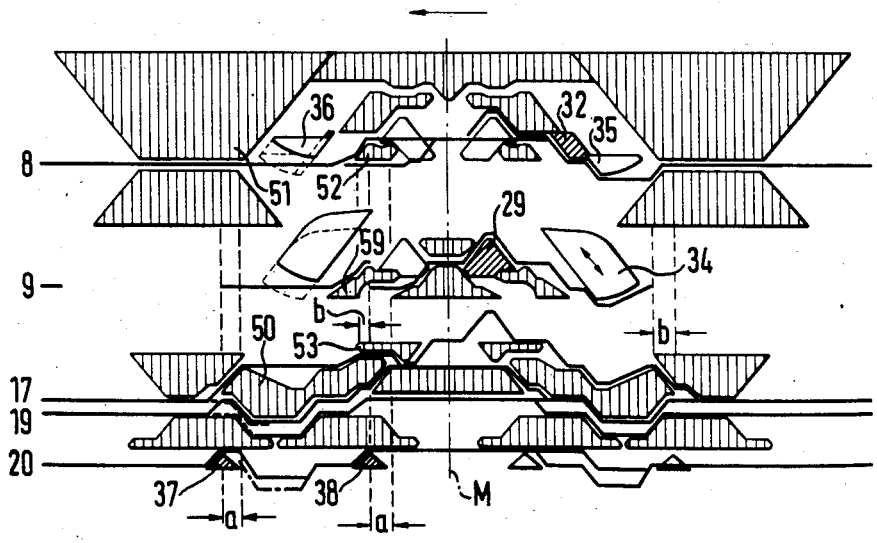
FIG. 8 is a plan view, as in FIG. 5, shifted for working by the three-path technique for the formation of tuck loops and stitches with the same withdrawal length.

FIG. 8 shows the embodiment according to FIG. 6 shifted to the cam setting for the three-path technique and for the production of equal size tuck loops and stitches. The cam units 29 and 32 are shifted into action. The selection keys 37 and 38 are appropriately controlled by selection magnets; selection key 37 chooses that flexible shank needle 2 which is to form the tuck loop, and selection key 38 chooses that flexible shank needle 2 which is to form the stitch. The needle sinker 34 is brought to the withdrawal position and the needle sinker 35 is brought to the same withdrawal position.

The flexible shank needles 2 forming tuck loops are coupled by fixed cam units 50 and 51 in the coupling zone a to the selected arresting jacks 3, and subsequently, by a fixed cam unit 59 engaging against the active needle butts 9, have their first needle butts 8 extended into the operating zone of a fixed cam unit 52, and are extended by this to the tuck level. Upon lifting by the cam unit 52 and by a holding of the arresting jack butt 17 against a fixed cam unit 53, the selected flexible shank needles 2 are uncoupled in the uncoupling zone b. Their second needle butts 9 disappear into the needle bed and can then no longer be engaged by the following cam units. The withdrawal of these flexible shank needles 2 selected for the formation of tuck loops then follows by means of the needle sinker cam unit 32 and the needle sinker 35.

The flexible shank needles forming stitches are chosen by the selection key 38. The further pass movement of these flexible shank needles 2 chosen for the formation of stitches corresponds to that shown in FIG.

6 and described above, with the exception that the needle withdrawal is effected by the needle sinker cam unit 32 and then first by the needle sinker 34.

If, with the cam shift according to FIG. 8 in the three-path technique, one wishes to produce knitting with small tuck loops and large stitches, then the needle sinker 34 must be deeper than the needle sinker 35. The needle butts 8 of the flexible shank needles 2 chosen for the formation of tuck loops are then withdrawn to a lesser depth, since their needle butts 9 are sunk again into the needle bed 1 and consequently cannot be engaged by the needle sinker 34. The flexible shank needles 2 chosen for the formation of stitches are withdrawn deeper by the needle sinker 34 by way of their high-standing needle butts 9. Their needle butts 8 can be affected by the needle sinker 35 only up to withdrawal to the lesser depth.

Figure 9:
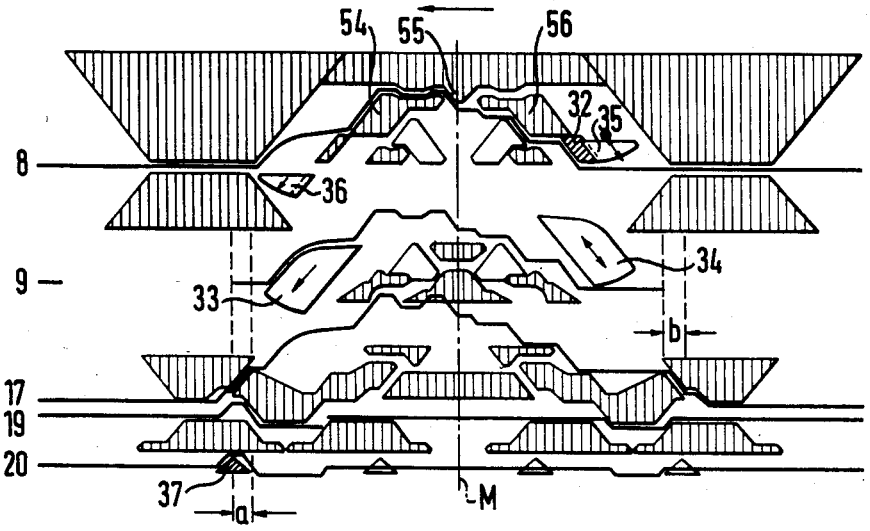
FIG. 9 is a plan view, as in FIG. 5, shifted for the donation of stitches in the transfer process.

FIG. 9 shows the cam shift of the cam system shown in FIGS. 5 to 8 for carriage movement from right to left for the donation of stitches in the stitch transfer process. The selection key 37 and the needle sinker cam unit 32 are shifted into action. The needle sinkers 33 and 36 are displaced downwardly in the plane of the cam unit sufficiently far that the needle butts 9 of the flexible shank needles 2 selected for the donation are engaged by the needle sinker 33 in the advancing sense and the needle butts 8 of the flexible shank needles 2 which are not selected cannot be engaged by the needle sinker 36 and consequently the unselected flexible shank needles 2 run through the cam unit in the level-cams position without being lifted or withdrawn. The first needle butts 8 of the flexible shank needles 2 selected for the donation, which have been extended by the needle sinker 33 in the advancing sense and which have been brought into the zone of a fixed donor cam unit 54, are extended in known manner for the donation by this donor cam unit 54 and subsequently are withdrawn to the level-cams position by a fixed withdrawal cam unit 55 and a fixed donor cam unit 56 as well as by the active needle sinker cam unit 32. The needle sinkers 34 and 35 stay at the level-cams position or, if necessary, somewhat deeper.

Figure 10:
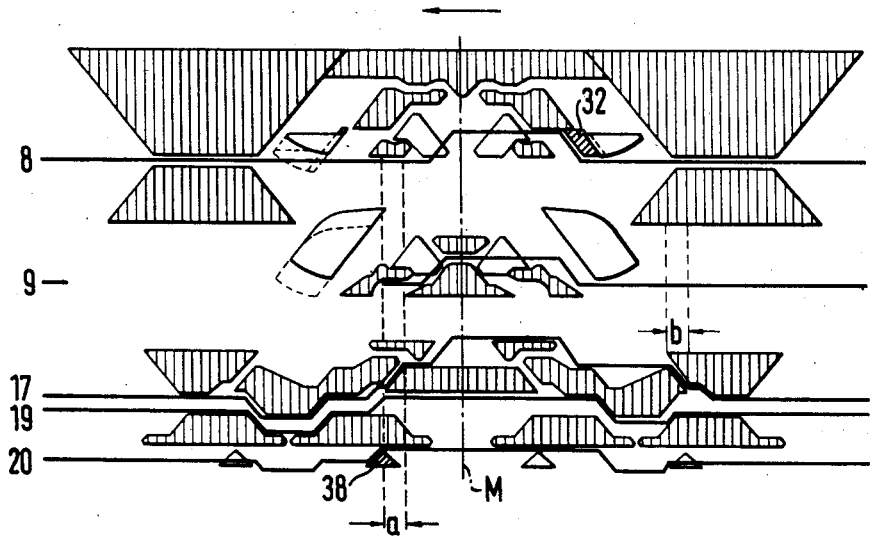
FIG. 10 is a plan view, as in FIG. 5, shifted for the acceptance of stitches in the transfer process.

FIG. 10 shows the cam shift of the cam system of FIGS. 5 to 9 into the setting for acceptance of stitches with a carriage traverse from right to left. The selection key 38 is active. In the transfer from front needle bed to rear needle bed, the needle sinker cam unit 32 can be brought into action. With transfer from rear needle bed to front needle bed, or with a transfer in both directions at the same time, the needle sinker cam unit 32 must in general be put into action since after the donation of the stitch the needle must either be withdrawn at the same time or the donor needle must be withdrawn earlier than the accepting needle.

This is dependent however on which positions the needles occupy in the front needle bed and in the rear needle bed for the transfer operation, i.e. the needles in the front needle bed slide past the needles in the rear needle bed to the left or to the right. The needle pass movement and jack pass movement effected by the cams is, in its essential parts, the same as described above in connection with FIG. 7.

Figure 11:
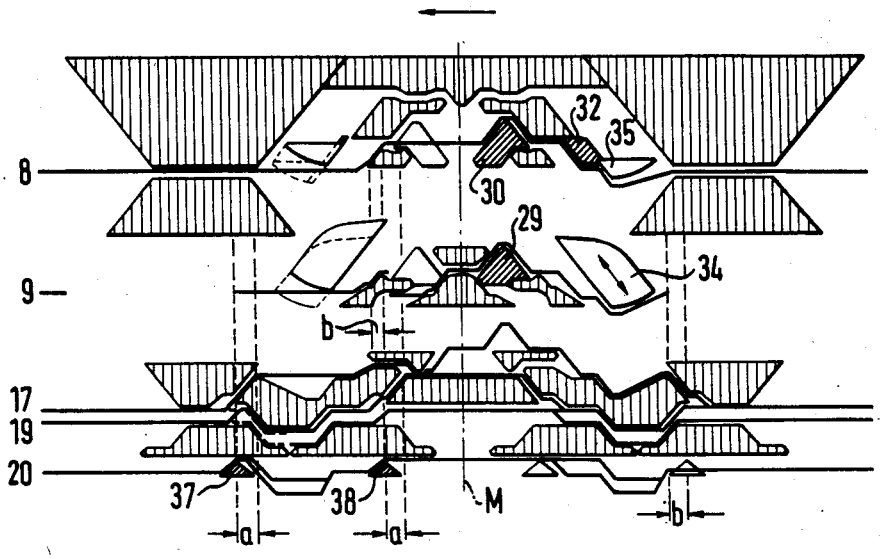
FIG. 11 is a plan view, as in FIG. 5, shifted for the formation of short and long stitches.

FIG. 11 shows the cam shift of a cam system according to FIGS. 5 to 10 for the formation of large and small stitches during a traverse of the carriage from right to left. Cam shift and needle and jack pass movements are essentially the same as described above in connection with FIG. 8, and the formation of large stitches and small tuck loops is as described above, with the difference that the cam unit 30 is additionally shifted into action. The flexible shank needles chosen by the selector key 37 are then likewise extended to stitch level.

Figure 12:
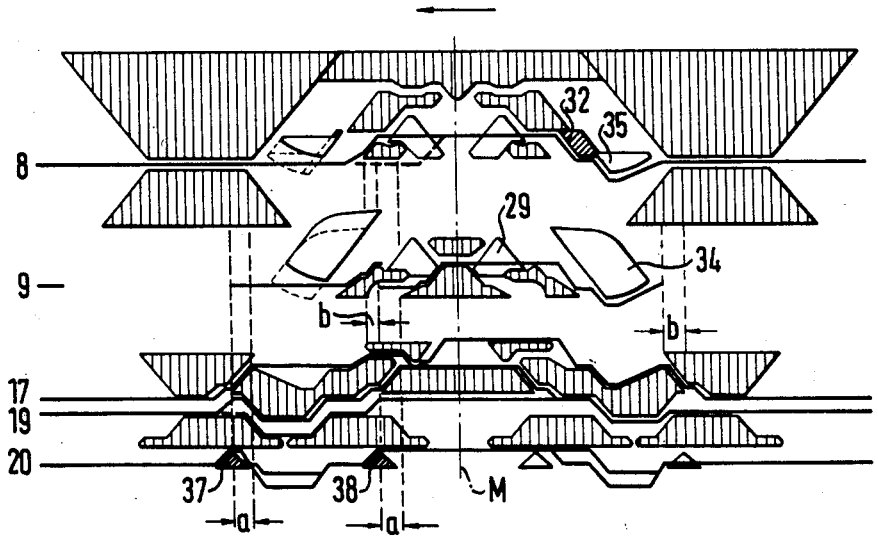
FIG. 12 is a plan view, as in FIG. 5, shifted for the formation of short and long tuck loops.

FIG. 12 shows the cam shift of a cam system according to FIGS. 5 to 11 with traverse of the carriage from right to left for the formation of small and large tuck loops. The cam shift and the needle and jack pass movements are the same as in connection with FIG. 8 for the formation of small tuck loops and large stitches, with the difference that the cam unit 29 is here inactive. The flexible shank needles 2 chosen by the selection key 38 are then likewise extended only to tuck level.

Figure 13:
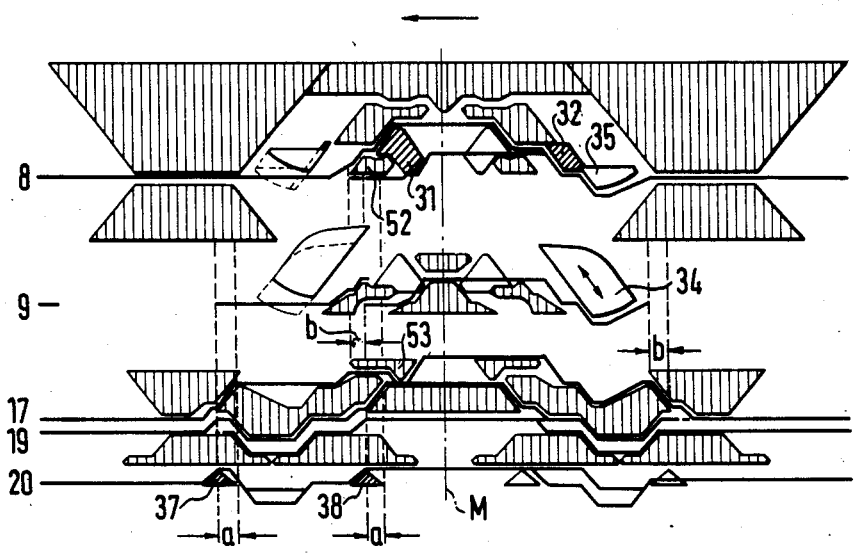
FIG. 13 is a plan view, as in FIG. 5, shifted for working by the three-path technique for the formation of short stitches and long tuck loops.

FIG. 13 shows the cam shift of a cam system according to FIGS. 5 to 12 for the three-path technique and for the formation of small stitches and large tuck loops with traverse of the carriage from right to left. Cam shift and needle and jack pass movements are the same as described above in connection with FIG. 12, with the difference that the cam unit 31 is shifted into action and consequently the flexible shank needles 2, which have been chosen by selection key 37 and which have been uncoupled again in the uncoupling zone b by the cam units 52 and 53, are extended by way of their needle butts 8 to matrix level.

The following selective needle and jack pass movements are possible with the cam system described with reference to FIGS. 5 to 13;

(a) Formation of equal size stitches, FIG. 6, (b) Formation of equal size tuck loops, FIG. 7, (c) Three-path technique, formation of equal size tuck loops and stitches, FIG. 8.

(d) Three-path technique, formation of small tuck loops and large stitches, FIG. 8 modified, (e) Donation of stitches, FIG. 9, (f) Acceptance of stitches, FIG. 10, (g) Formation of small and large stitches, FIG. 11, (h) Formation of small and large tuck loops, FIG. 12, and, (i) Three-path technique, formation of small stitches and large tuck loops, FIG. 13.

Figure 14:
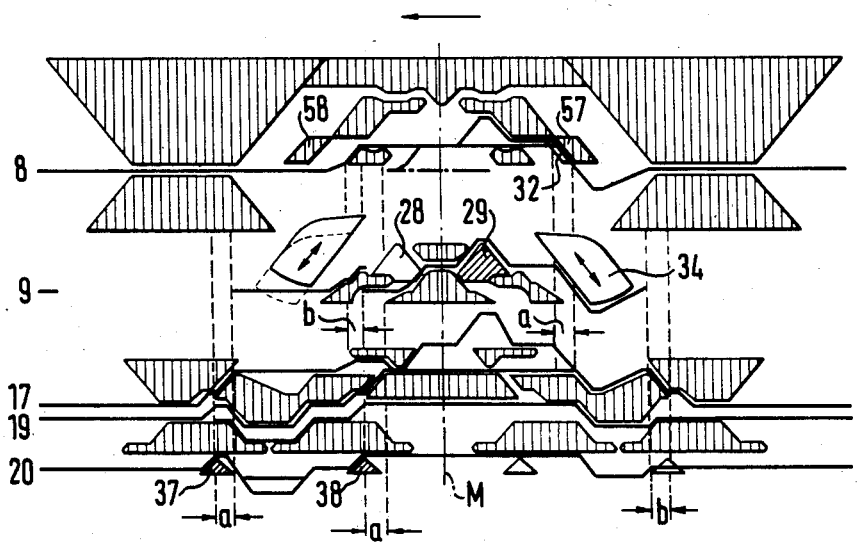
FIG. 14 is a plan view of a simplified cam system according to the invention with constant needle withdrawal during one row of knitting, shifted for the three-path technique for the formation of equal length tuck loops and stitches; and, FIG. 15 is a schematic plan view of a further embodiment of cam system in accordance with the present invention.

FIG. 14 shows a simplified embodiment of a cam system by means of which no selective differential needle withdrawal can be achieved. In this embodiment the shiftable cam units 30 and 31 as well as the needle sinkers 35 and 36 are absent, while fixed cam units 57 and 58 are added. The shiftable needle sinker cam unit 32 is only required for the transfer process. For the rest, the needle and jack pass movements correspond to those of FIGS. 6, 7, 9 and 10.

Figure 15:
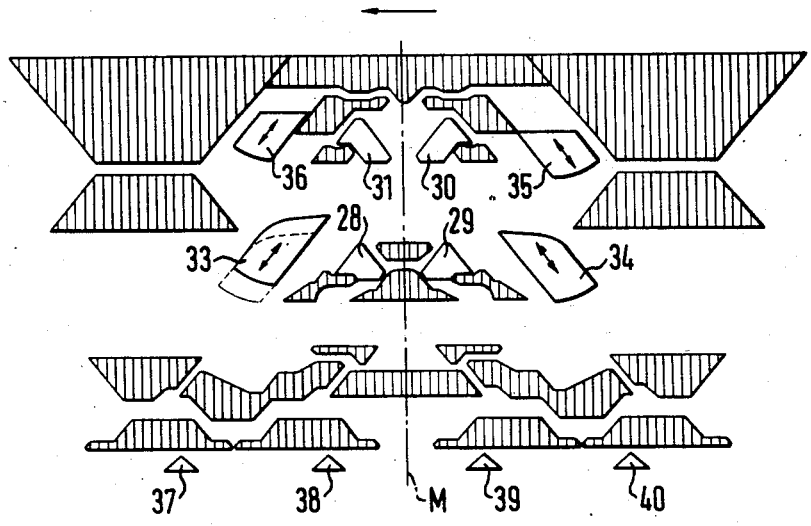

FIG. 15 shows a further embodiment of a cam system. In this cam system the shiftable needle sinker cam unit 32 is absent. The displaceable needle sinkers 35 and 36 are retractable, for example by being arranged pivotably. With the needle and jack pass movements according to FIGS. 6 and 7, the needle sinker 35 is inactive, and with the needle and jack pass movements of FIGS. 8,9,10,11,12 and 13 the needle sinker 35 is active. For the rest, similar needle and jack pass movements can be effected as the needle and jack pass movements effected according to FIGS. 6 to 13.

Generally speaking, in order to achieve a higher knitting output, a plurality of cam systems can be arranged next to one another.

I claim:

1. A flat knitting machine comprising flexible shank needles arranged in the needle channels of the needle bed, each said needle having an anterior first needle butt always projecting from the needle bed and a posterior second needle butt which sinks into the needle bed under the resilience of its own flexible shank, jacquard jacks arranged rearwardly of the flexible shank needles for selective lifting of said second needle butts, and cam means movable over the needle bed and comprising interengageable needle cam units, jacquard cam units and selection cam units incorporating fixed and shiftable cam elements, in which (a) behind each flexible shank needle there is provided a displaceable arresting jack having both an arresting jack butt and also a coupling portion at its forward end for coupling to the flexible shank of the flexible shank needle and for simultaneously lifting said second needle butt from the needle bed, (b) behind the arresting jack there is displaceably mounted a jacquard jack having a first, operating butt and a second, selection butt, and (c) in the needle cam unit, at least in the region of said second needle butt, and symmetrically arranged with respect to the central longitudinal axis of the cam means, there are provided two needle sinkers displaceable in the plane of the cam means and two cam units shiftable into and out of the plane of the cam means for extending the needles for the formation of stitches.

2. A flat knitting machine according to claim 1, in which, in the needle cam unit in the region of said first needle butt, and symmetrically arranged with respect to the central longitudinal axis of the cam means, there are provided two needle sinkers displaceable in the plane of the cam means and two cam units shiftable into and out of the plane of the cam means for extending the needles for the formation of stitches, and also a shiftable needle sinker cam unit provided in the region of one of said needle sinkers.

3. A flat knitting machine according to claim 1, in which four selectively shiftable selection keys are provided in the selection cam unit and arranged symmetrically with respect to the central longitudinal axis of the cam means.

4. A flat knitting machine according to claim 2, in which the displaceable needle sinkers in the needle cam unit in the region of the first needle butt are replaced by fixed cam units and in which said two shiftable cam units are omitted.

5. A flat knitting machine according to claim 2, in which the shiftable needle sinker cam unit in the needle cam unit in the region of the first needle is omitted and the displaceable needle sinkers are retractable, for example pivotable.

6. A flat knitting machine according to claim 1, in which at the underside of each said second needle butt there is provided an arresting cam with two oppositely directed inclined cam surfaces, and in which the coupling portion of each arresting jack is provided with a latching groove to receive said arresting cam and is provided at its forward end with two further oppositely directed inclined cam surfaces.

7. A flat knitting machine according to claim 1, in which the jacquard jack is arranged to be slidable in part on the arresting jack.

8. A flat knitting machine according to claim 1, in which the active operating zone of the arresting jack butt extends over the width of a lengthwise recess in the upper surface of the needle bed.

9. A flat knitting machine according to claim 3, in which the selection butts of successive jacquard jacks and the associated selection keys are arranged staggered in the needle channel length direction.

* * * * *

UNITED STATES PATENT AND TRADEMARK OFFICE

CERTIFICATE OF CORRECTION

PATENT NO. : 4,662,192

DATED : May 5, 1987

INVENTOR(S) : Reinhold Schimko

It is certified that error appears in the above-identified patent and that said Letters Patent is hereby corrected as shown below:

On the title page assignee should read

-- [73] Assignee: Universal Maschinenfabrik Dr. Rudolf Schieber GmbH & Co. KG --

Signed and Sealed this

Eighth Day of December, 1987

*Attest:*

*Attesting Officer*

DONALD J. QUIGG

*Commissioner of Patents and Trademarks*